US007647654B2

(12) United States Patent
Shamroth

(10) Patent No.: US 7,647,654 B2
(45) Date of Patent: Jan. 19, 2010

(54) DISH BASIN AND CUTTING BOARD

(76) Inventor: Harry Shamroth, 283 Hempstead Ave., Rockville Centre, NY (US) 11570

( * ) Notice: Subject to any disclaimer, the term of this patent is extended or adjusted under 35 U.S.C. 154(b) by 429 days.

(21) Appl. No.: 11/242,163

(22) Filed: Oct. 3, 2005

(65) Prior Publication Data

US 2007/0074339 A1 Apr. 5, 2007

(51) Int. Cl.
*E03C 1/33* (2006.01)

(52) U.S. Cl. ..... 4/631; 4/637; 220/801; 269/289 R

(58) Field of Classification Search ..... 4/637, 4/656, 631, 638–640, 642, 654; 108/13, 108/14, 25; 134/85; 220/801; 269/289 R; 312/228, 308
See application file for complete search history.

(56) References Cited

U.S. PATENT DOCUMENTS

| | | | | | |
|---|---|---|---|---|---|
| 132,165 | A * | 10/1872 | Maples | 312/228 X |
| 214,271 | A * | 4/1879 | Zundorff | 312/228 |
| 489,951 | A * | 1/1893 | Hartsock | 312/308 X |
| 1,315,101 | A * | 9/1919 | Ehrke | 269/289 R |
| 2,194,343 | A * | 3/1940 | Wexler | 4/637 |
| 3,048,463 | A * | 8/1962 | Kauffman | 108/13 X |
| 4,305,166 | A * | 12/1981 | Rose | 4/637 X |
| 5,938,185 | A * | 8/1999 | Kletter | 269/289 R |
| 6,453,488 | B1 * | 9/2002 | Shamroth | 4/637 |
| 7,086,099 | B2 * | 8/2006 | Rocci | 4/656 |

* cited by examiner

*Primary Examiner*—Robert M Fetsuga

(57) ABSTRACT

A basin for installation into an opening defined by a kitchen countertop, the countertop having a substantially uniform planar top surface, where the basin includes a wall defining a reservoir, a ledge disposed along at least a portion of the wall and a cover contacting the ledge within the reservoir such that the cover top side is level with the countertop surface. The basin cover underside receives and retains a cutting board which may be accessed by a user and removed for use anywhere in the kitchen.

7 Claims, 5 Drawing Sheets

DISH BASIN AND CUTTING BOARD

FIELD OF THE INVENTION

The present invention relates to the field of kitchen amenities and in particular dish washing basins, cutting boards, and covers therefore which provide additional kitchen work surface area.

BACKGROUND OF THE INVENTION

The art of dish wash basins and dish racks is practically as old as indoor plumbing. As such, people have always been faced with the dual problem of finding enough space for their dish washing needs, including drying space and racks therefore, without having to sacrifice kitchen countertop space used for other needs, such as cutting and preparing food. As clearly, food preparation and dishwashing surfaces are not a practicable co-existence option for the same space, often one of these functions had to be sacrificed to the demands of the other. Portable and movable dish racks and dish drain boards, such as in U.S. Pat. Nos. 5,105,485; 4,589,150; and 4,480,343 are one attempt at a solution, but involve bulky and or wet surfaces, disposed at inclines for drainage, which limit their placement and options for their use with respect to other kitchen functions. Also, as disclosed, these items tend to disperse and channel water and other fluids over the countertop, thus increasing chances of cross-contamination of food preparation areas.

Attempts to solve the problem by placing covers over sinks have also been attempted as space savers, as disclosed in U.S. Pat. Nos. 5,815,855; 227,575; 6,814,090; and D449,875. These attempts have the effect of increasing usable space, but the sink covered is also often the major source of water for the kitchen, and is in almost constant use not only when dishes are washed. Thus, constant covering and recovering is needed to maintain the food preparation surface and a functioning sink and water source. U.S. Pat. No. 4,305,166 discloses a hinged sink cover that opens up onto the neighboring countertop. It provides workspace such as dish drain or cutting board on the opposite side of the sink cover, but this only solves the problem the covers themselves create as they encroach upon surrounding workspace. Moreover, none of these illustrate creation of a surface over the sink basin that is co-extensive or co-planar with the countertop surrounding the sink. None also solve the problem of using a space for dishes on the countertop after they leave the sink without sacrificing countertop food preparation area.

These problems in the prior art are overcome by the present invention which structurally integrates a dish basin with the countertop surface while also providing space for storing and retrieving a cutting board that can be used elsewhere in the kitchen, including over the basin and without being on an incline.

SUMMARY OF THE INVENTION

The present invention relates to a basin having a cover, the cover comprising holders for removeably receiving and retaining a cutting board.

Further contemplated by the invention is a basin for installation into an opening defined by a kitchen countertop, the countertop having a substantially uniform flat planar top surface, the basin comprising a basin wall having a height and defining a reservoir a support device disposed along at least a portion of the wall at a pre-determined wall height location and a basin cover having a substantially uniformly planar top side and an underside, the cover underside configured for removeably receiving and retaining a cutting board, the cover contacting the support device at a plurality of cover contact portions so that the cover is disposed over at least a portion of the reservoir, the cover contact portions having a height dimension such that when contacting the support device at the pre-determined wall height location, the cover top side is substantially co-planar with the countertop flat planar top surface.

Further contemplated by the invention is a method of installing a basin with a cutting board in a kitchen countertop defining a substantially uniform planar surface, the method comprising, providing a basin with a drain, having a flanged lip, said basin having a cover with a top side and an underside, said underside comprising means for receiving and retaining a cutting board, inserting the basin into an opening defined within a kitchen countertop, fastening the basin flanged lip to at least a portion of the kitchen countertop, and leveling the basin and cover such that the cover top side is substantially co-planar with the planar surface of the countertop.

DETAILED DESCRIPTION OF THE INVENTION

Figure 1:
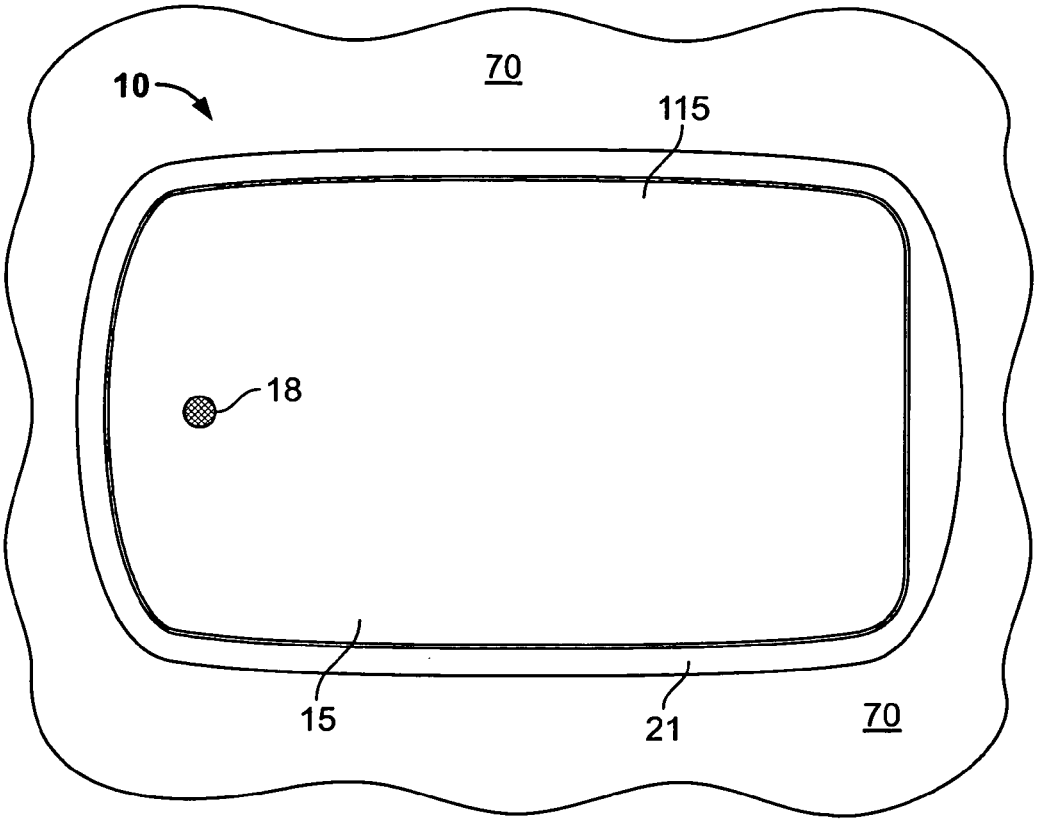
FIG. 1 is a top plan view of the basin according to the preferred embodiment of the invention.

The present invention relates to a basin, which may be a dish drain, and a basin cover where the cover removeably retains a cutting board. Preferably, the basin is installed in an opening defined by a kitchen countertop, preferably a countertop defining a substantially uniform flat planar surface. A basin wall, of a pre-determined size, and which may be curved or use straight segments to define the area of a recessed reservoir. A support device integral with or coupled to the basin wall supports the basin cover when in place to cover at least part of the reservoir. The support device can be a flat space, a slot, or an extension or other protrusion such as a knob, buttress, handle, bar, tab, or other feature or combination of features which the basin cover and/or its holders, contact, rest on, or are releaseably coupled or fastened to.

In the preferred embodiment, the support device is at lease one ledge which extends along at least a portion of the wall (hereafter referred to as "ledge portions"). The ledge portions are located at a pre-determined height distance on the wall commensurate with a width size the basin cover presents at a point of contact with ledge portions such that, by so contacting the ledge portions, the cover fits within a pre-determined space to cover at least a portion of the recessed reservoir while the cover top surface is supported and elevated sufficiently so as to be substantially co-planar with the surrounding and/or neighboring kitchen countertop surface. This is the preferred cover overlay position. In lieu of a ledge portion, placement of another type of support device at a pre-determined wall location may also be used to achieve this co-planar cover disposition.

The basin cover underside has holders for receiving and retaining the cutting board, the cutting board being readily removable for use elsewhere in the kitchen. In the preferred embodiment, these holders have a width size and protrude from the basin cover underside at points so as to contact the ledge portions and thus support the basin cover in the preferred overlay position.

The basin and cover can be used in new kitchen installations or in remodeling of existing kitchens. Basin and cover can be of varying widths and sizes according to marketing and design preferences. Typically, the basin will have lateral side dimensions between about 16 inches and 40 inches in length per side and the basin can be square, rectangular, curved, oval circular or any suitable combination of geometric shapes and lines conforming to its intended placement and function. The basin can have various recessed, or longitudinal, depths, typically these being between 1 to 12 inches.

The cover is rigid and conforms to the shape of the reservoir defined by the basin walls. The cover can overlay the entire reservoir area or a portion thereof and has a substantially flat top surface. The cover longitudinal width can be uniform or variable and preferably between about 0.05 inches and about 2 inches. Preferably, the cover is of uniform width save for at certain points which contact the support devices. For instance, combined with the holders on the underside, these points extending downward on the underside of the basin cover present a longitudinal width of between about 0.5 and 0.75 inches at the point or points contacting the ledge portions. The ledge portions are located at a recessed depth on the basin wall commensurate to the combined cover and holder width at the cover contact points. The ledge portions can be a single continuous ledge around the basin wall or multiple ledges, for instance, they can be two or more opposing ledge portions on the basin wall. Preferably, when placed on the ledge portions and over the reservoir, the cover fits in a space bounded by a surrounding lip portion of the basin, which may be flanged, and, though smaller in surface area than the basin, generally conforms to the overall basin outline. The cutting board can be of most any size and shape that can be accommodated by the cover underside holders and is made of typical cutting board materials, including wood, plastic, polymer composites, and the like.

The invention will be further described with respect to the drawings directed to the preferred embodiment. It must be appreciated that the drawings reflect sizes and proportions of the invention for ease of illustration and that the actual sizes, distances and proportions of the invention and its elements are variable and subject to the design choice of the practitioner. FIG. 1 shows a top plan view of the preferred embodiment of the invention. Basin 10 includes a recessed area wherein cover 15 entirely fits. Cover 15 includes an aperture 18 allowing it to be grasped by a user and lifted off of basin 10. Preferably, cover 15 occupies most of the surface space defined by basin 10 recessed area, but other sizes, dimensions and proportions are also within the scope and contemplation of the invention, for instance, sizes which cover only a portion of the recessed area. Flanged lip portion 21 of basin 10 extends around outermost edge of basin 10, and around the basin recessed area. When basin 10 is installed in a kitchen countertop, the underside (not pictured) of flanged lip 21 contacts and adheres to countertop 70 at a surface proximate to basin 10 at a point of installation. When cover 15 is placed over basin 10 recessed area, flanged lip 21 defines an outer surface edge of the basin that is between cover 15 and the countertop 70 surface beyond flanged lip 21.

Preferably, as installed, and as will be visible in other figures, flanged lip 21, cover 15, and countertop 70 present a substantially uniform and co-extensive planar surface, acting as an extension of countertop 70, rather than presenting an elevational obstruction often presented by other kitchen articles, such as dish racks and drain pads. The substantially uniform planar surface created facilitates use of covered basin 10 as a substantially flat work area.

Figure 2:
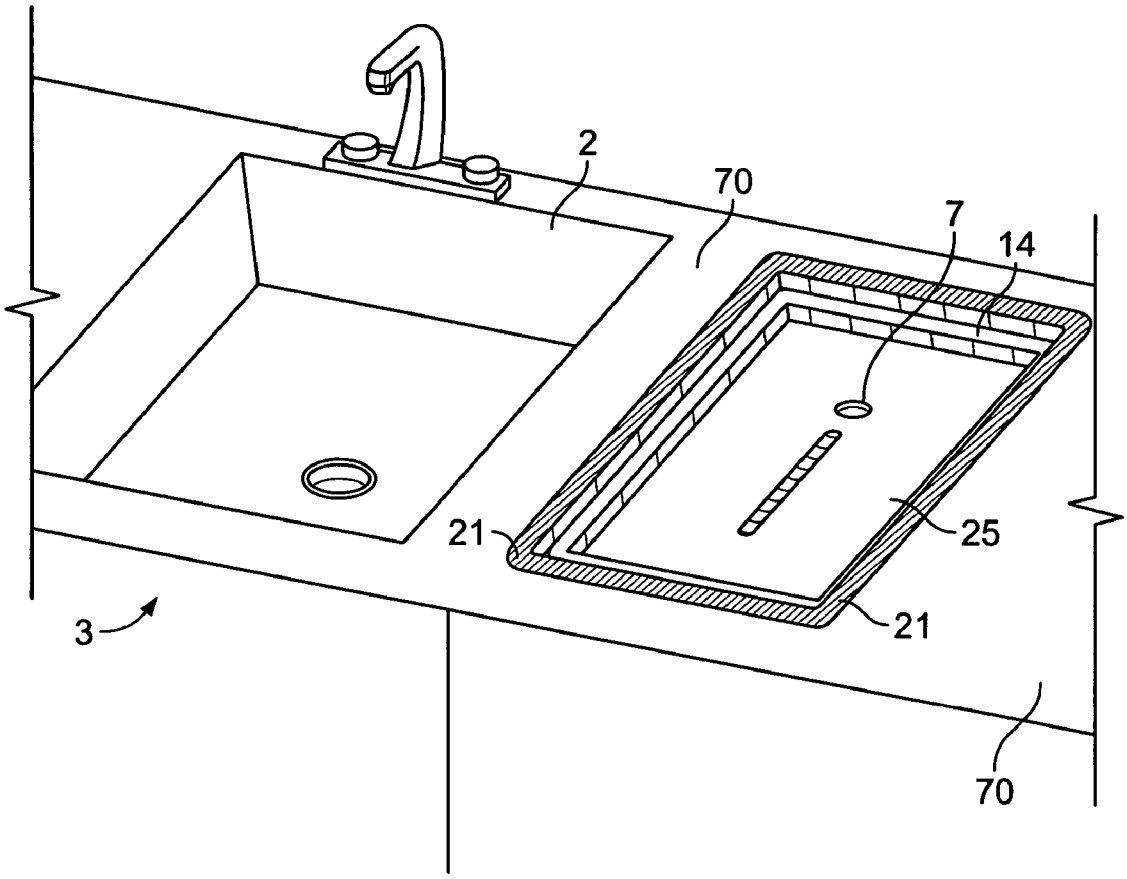
FIG. 2 is a perspective view of the basin according to the preferred embodiment, as installed in a kitchen.

FIG. 2 shows the preferred installation of basin 10 (without cover 15) in a space defined by countertop 70, and/or which may be a cut out of said countertop 70. Kitchen sink 2 atop sink base 3 is shown adjacent to basin 10, but placement of sink 2 proximate to basin 10 is not critical. Unless basin 10 shares the same waste drain line, sink 2 need not even be present. Basin 10 has walls which define a recessed area, here reservoir 25, which may have portions that are concave, sloped, channeled or which are of any other shape that allows drainage. Drain 7 drains reservoir 25. Basin 10, cover 15, and reservoir 25 can be of metal or coated metal, preferably stainless steel or enamel coated iron, but other materials such as CORIAN, solid surface veneer (SSV) or plastic may be used. In some embodiments, cover 15 may be of a different material than basin 10. This material may be the same as the countertop 70 top surface, such as FORMICA for instance, and optionally of matching color and texture. Cover 15 could also be made of marble, granite, or other more decorative material. Ledge portions 14 extend at least a portion around basin 10 walls defining the recessed reservoir, and which may be multiple ledge portions 14 located, for instance, on opposing sides of the reservoir, contacts and supports cover 15 as placed within basin 10 and over reservoir 25.

Figure 3:
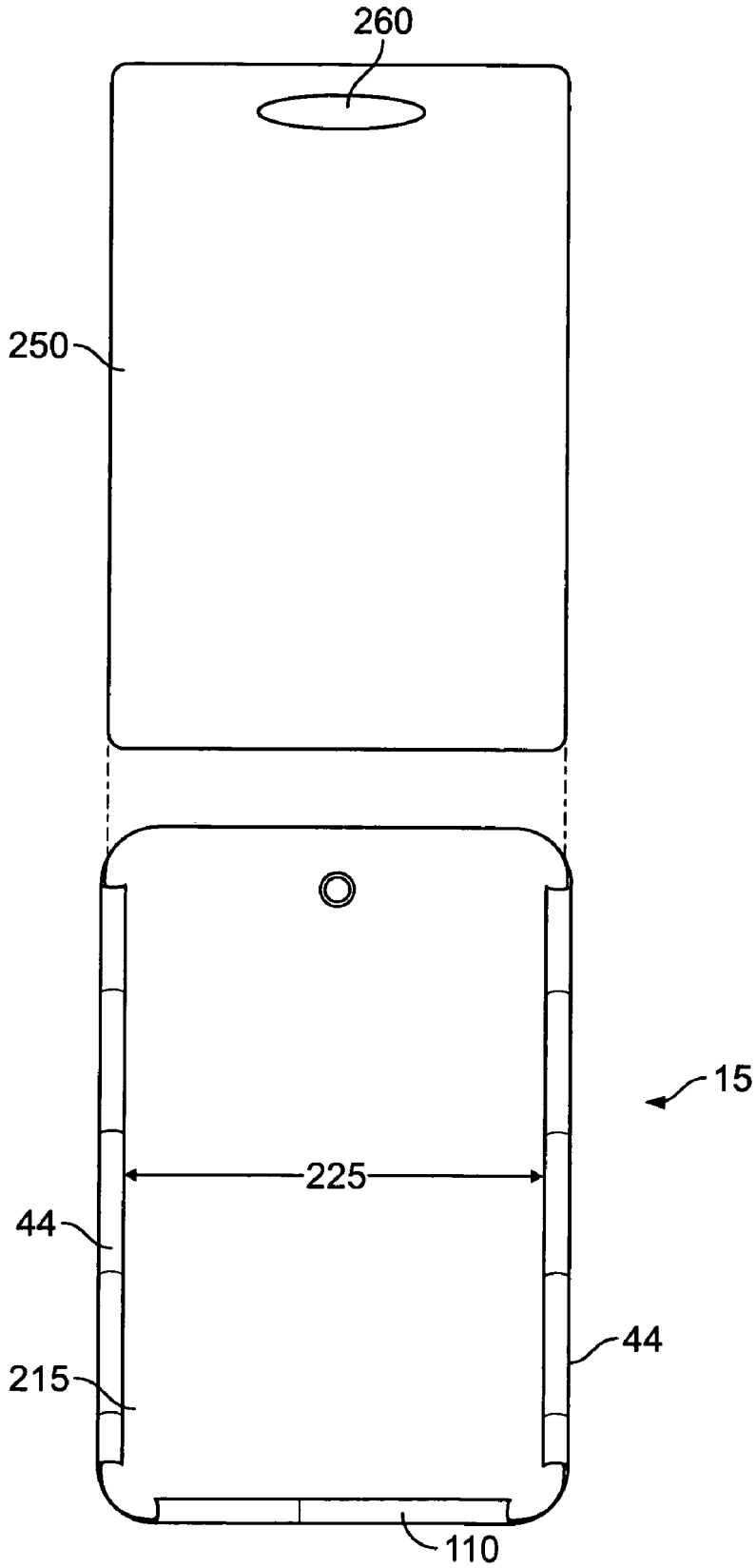
FIG. 3 is a bottom plan view of the cover, including cutting board, according to the preferred embodiment of the invention.
Figure 3A:
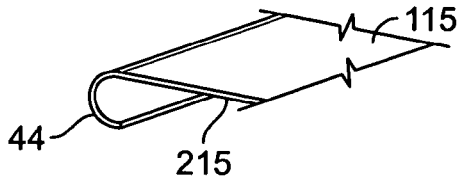
FIG. 3*a* is a perspective view close up of a portion of the cover illustrated in FIG. 3.

FIG. 3 is a bottom plan view of cover 15, which has a top side 115 and underside 215. A cutting board 250 is received and retained into a slot location 225 defined by holders which may be, for instance, opposing tracks 44 on underside 215, each track 44 having a curved shape so as to contact and extend around the edges of cutting board 250 so received into slot location 225. FIG. 3*a* illustrates the curve of track 44 in perspective. In this way, cutting board 250 can be alternatively inserted and removed from slot location 225, and otherwise retained on underside 215. Preferably, insertion and removal of the cutting board 250 is by manipulating handle aperture 260 at the proximate end of cutting board 250 (but this is not critical) and inserting the cutting board 250, at the distal end, between tracks 44. As pictured in FIG. 3, and other figures, tracks 44 are each extensions of cover 15 each integral with cover 15 and formed by folding, curving, bending or otherwise contouring opposing edges of cover 15 back and towards the center of cover 15 on underside 215. Where cover 15 is stainless steel, opposing tracks 44 can be formed in a metal sheet piece used for cover 15 with standard metal shaping production methods known in the art. Tracks 44 can be formed in other ways as well, such as using metal pieces fastened, for instance, welded, to cover underside 215. Tracks 44, whether integral to cover 15 or coupled thereto, are spaced apart and opposing so as to juxtapose opposing longitudinal channels so defining slot location 225, which is slightly larger than the size of a width of cutting board 250 (which may be of varying widths and sizes according to the design preferences), tracks 44 contact cutting board 250, such that the cutting board is removeably retained in slot location 225 on underside 215. Optionally, a third track 110 configured so as to define a channel running perpendicular to opposing tracks 44 on underside 215 and/or across at least a portion of slot location 225 may be added for contacting the cutting board 250 distal end. Third track 110 may or may not contact a corresponding basin ledge portion.

Other suitable structure and ways of attaching and holding the cutting board to the cover underside are within the scope and contemplation of the invention, including using holders that are releasable fasteners, hooks, VELCRO ® patches and strips, tracks, channels, grooves, receiving apertures, sleeves, or any combination of the foregoing, whether these are in the positions as shown in FIG. 3, or in other positions otherwise suitable for removeably receiving and retaining a cutting board. Moreover and alternatively, it is within the scope and contemplation of the invention for the cutting board to be adhered or fastened such that it is intrinsic to the underside and is immovable, for instance attached with a suitable adhesive or formed as the underside of the same piece of material comprising cover 15. The example shown in FIG. 3, though preferred, is only one way of attaching cutting board 250, other ways of attachment and for removable disposition of the cutting board on cover underside 215 would occur to one of skill in the art.

Figure 4:
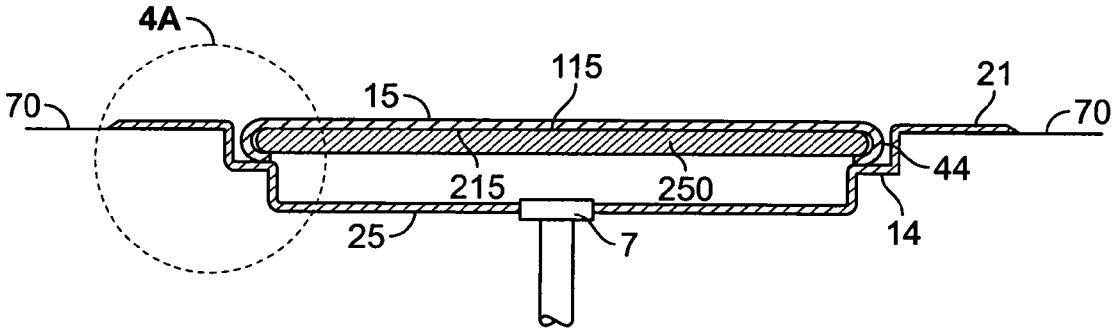
FIG. 4 is a cross-sectional view of the basin of FIGS. 1-3, as installed.
Figure 4A:
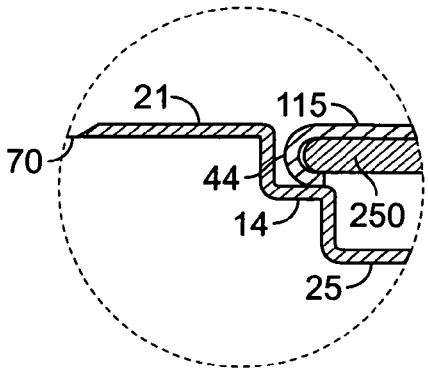
FIG. 4*a* is a close-up view of a portion of the cross sectional view of FIG. 4.

FIG. 4 is a cutaway view of basin 10 in cross-section as installed in an opening defined by countertop 70 including reservoir 25, ledge portions 14 (which may represent one continuous ledge or opposing ledges), and drain 7. In installation, basin 10 has been inserted into the opening and flanged lip 21 placed over and fastened to at least a portion of the surrounding countertop surface. Cover 15 ultimately rests on ledge portions 14 by holders on cover underside 215. In the preferred embodiment shown, the holders are tracks 44 which contact the ledge portions 14 such that the cutting board 250 is supported above the reservoir 25 and contacts no other surfaces of basin 10, thus promoting safe usage in food handling. Third track 110, not pictured in FIG. 4, may or may not contact a corresponding ledge portion.

In installation, it is important that basin 10 be leveled correctly and consistently with the countertop surface. Preferably, upon installation flanged lip 21 presents only a very slight raised elevation, if any, above the countertop 70 surface. Cover 15 is of a uniform longitudinal width save for cover contact portions, here at tracks 44, which contact ledge portions 14. Tracks 44 are of a pre-determined width that is approximately the same as the distance between the upper wall portion of basin 10 and ledge portions 14. For instance, this distance and/or width may be about 0.5 inches. As tracks 44 are also configured to receive and retain cutting board 250, the width of the cutting board used (which is largely within the scope of particular design choice and preference) affects the size of tracks 44 and consequently the distance between basin 10 upper wall portion and ledge portions 14. While preferably width of tracks 44 and distance of the ledge portions on the basin 10 wall are commensurate, they do not need, necessarily, to be equivalent. For instance, tracks 44 can include legs, knobs, or other extending or buffer materials and structure to the bottom of tracks 44 which increase width at the point of contact with ledge portions 14 if the width of cutting board 250 is significantly smaller than the distance from upper wall to ledge portions 14.

As cover top side 115 defines a substantially uniform planar surface, over the lateral area defined by flanged lip 21, cover top side 115 and countertop 70, there is a substantially co-planar and co-extensive surface. This avoids obstacles and elevational irregularities on the countertop and presents a work area that is largely uninterrupted by basin 10 when the basin is covered. Drain 7 is coupled to an existing kitchen waste drain so that it is in fluid communication therewith. For instance, this can be done so as to allow drainage from the basin 10 through drain 7 to flow to the main sink waste drain or sanitary trap in the kitchen, or flow to other waste connections such as those for dishwashers or other appliances.

Optionally, basin 10 may include a dish grid (not pictured), either as described and defined in my prior patent, U.S. Pat. No. 6,453,488 (the disclosure of which is incorporated herein by reference). The dish grid may also be any other suitable horizontal dish drying rack or placement area, such that the dishes are disposed above the reservoir for drainage purposes. In addition, the invention contemplates inclusion of a standing dish rack, of metal, plastic or other suitable material, that is alternatively collapsible into a horizontal form for storage under cover 15, and retained cutting board 250, and within reservoir 25 when not in use.

Figure 5:
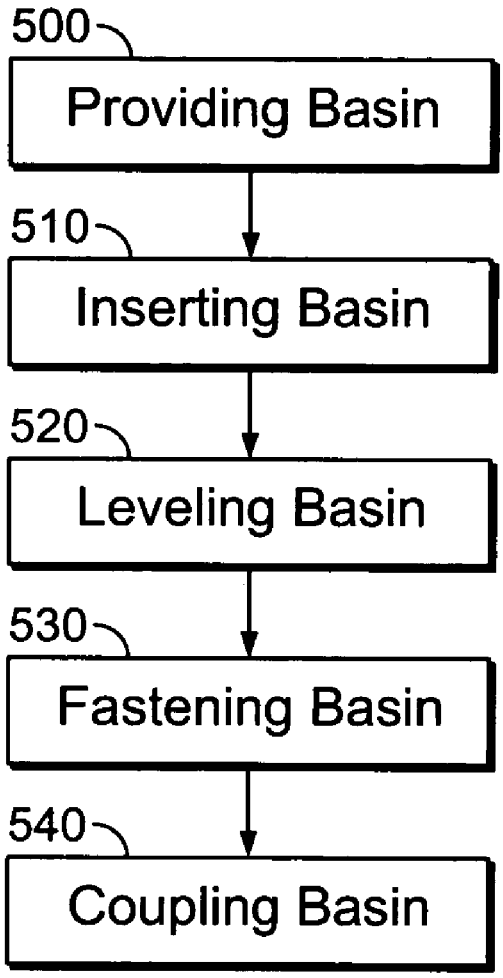
FIG. 5 is a flow chart illustrating an installation method for the basin of FIGS. 1-4*a*.

FIG. 5 is a flow chart referencing steps for installation in a kitchen countertop defining a substantially uniform planar surface. The method involves the steps of providing a basin with a drain, having a flanged lip, said basin having a cover with a top side and an underside, with the underside having structure, for instance, metal tracks, for receiving and retaining a cutting board 500 and 510 inserting the basin into an opening defined within the kitchen countertop. The method then involves at some point leveling the basin and cover such that the cover top side is substantially co-planar with the planar surface of the countertop once the flanged lip is fastened to the countertop 520. After insertion and leveling, the method involves fastening the basin flanged lip to at least a portion of the kitchen countertop 530 which can be done by epoxy adhesive or other suitable adhesive technique known in the art. Also, the method involves, coupling the drain to an existing kitchen waste drain so that it is in fluid communication therewith 540.

While the present invention has been described herein with reference to specific embodiments, those examples are intended to only be illustrative thereof and are not intended to limit the spirit or scope of the invention.

I claim:

1. A dish drain for installation into a countertop opening, where the countertop defines a substantially flat uniform planar surface, the dish drain comprising: a basin, the basin having a wall, the wall having an upper portion and the wall defining a reservoir area, the walls including a ledge portion extending along the wall at a pre-determined distance below the wall upper portion; and, a basin cover, having a substantially uniform planar top side and an underside, the underside having two opposing tracks and one perpendicular track, the tracks integral with the cover and together the tracks define a space for removeably receiving and retaining a cutting board therein, the tracks being of a pre-determined width of a size approximately that of the pre-determined distance between the ledge portion and the wall upper portion such that, when the cover is placed over the reservoir area and the tracks all contact the ledge portion, the basin cover top side is substantially co-planar with the countertop surface.

2. The basin of claim 1, wherein the basin cover defines an aperture for grasping and lifting the cover.

3. The basin of claim 1, further comprising a dish support grid disposed within the basin.

4. The basin of claim 3 wherein the dish support grid is a collapsible dish support rack storable within the basin and under the cover.

5. The basin of claim 1, further comprising a drain opening in fluid communication with a sanitary outlet.

6. The basin of claim 5, wherein the drain opening is in fluid communication with a kitchen sink drain line.

7. The basin of claim 1, wherein the basin further comprises a flanged lip coupled to the wall upper portion for contacting and adhering to a countertop surface proximate to said basin at a point of installation, the flanged lip defining an outer surface edge of the basin.

* * * * *